US006272795B1

(12) United States Patent
Bräuning

(10) Patent No.: US 6,272,795 B1
(45) Date of Patent: Aug. 14, 2001

(54) MOVABLE OFFICE FURNITURE

(75) Inventor: Egon Bräuning, Weil am Rhein (DE)

(73) Assignee: Vitra Patente AG, Muttenz (CH)

( * ) Notice: Subject to any disclaimer, the term of this patent is extended or adjusted under 35 U.S.C. 154(b) by 0 days.

(21) Appl. No.: 09/284,394

(22) PCT Filed: Oct. 6, 1997

(86) PCT No.: PCT/IB97/01212

§ 371 Date: Apr. 13, 1999

§ 102(e) Date: Apr. 13, 1999

(87) PCT Pub. No.: WO98/16135

PCT Pub. Date: Apr. 23, 1998

(30) Foreign Application Priority Data

Oct. 15, 1996 (CH) ..... 2509/96
Jun. 2, 1997 (CH) ..... 1313/97

(51) Int. Cl.[7] ..... E04B 2/74

(52) U.S. Cl. ..... 52/36.1; 52/36.5; 52/220.8; 52/235

(58) Field of Search ..... 52/36.1, 36.5, 52/220.1, 220.2, 220.8, 239

(56) References Cited

U.S. PATENT DOCUMENTS 2,636,224 * 4/1953 Murdoch et al. ..... 52/36.1
2,673,132 * 3/1954 Alderman ..... 52/36.1
3,848,364 * 11/1974 Costruba ..... 52/36.5
4,887,783 * 12/1989 Franklin ..... 52/239 X
5,487,246 * 1/1996 Hodges et al. ..... 52/220.7
5,715,633 * 2/1998 Raz et el. ..... 52/220.7
5,875,594 * 3/1999 Hellwig et al. ..... 52/220.7
5,979,118 * 11/1999 Gortsema et al. ..... 52/36.1

FOREIGN PATENT DOCUMENTS 0447961 9/1991 (EP) .
1388051 3/1975 (GB) .

* cited by examiner

*Primary Examiner*—Beth A. Stephan
*Assistant Examiner*—Brian E. Glessner
(74) *Attorney, Agent, or Firm*—Selitto, Behr & Kim

(57) ABSTRACT

Movable office furniture consisting of the following system components: a travelling table (1), a filing trolley (1) a cupboard, an equipment box and a shelf partition (7). Said office furniture can be used in permanent company offices, at exhibitions, conferences or in the home. The tables have no cross tie-bars close to the ground between legs. At least one interchangeable box (100) can be inserted into the various types of trolleys (4). Many of such boxes can be inserted into cupboards. Shelves can be installed on shelf partitions (7) and office equipment and stationery can be stored thereon. Shelf partitions (7) can be placed back to back to form a double wall in a room and have the advantage of being produced from sound absorbing material. The office furniture can be spontaneously rearranged and several components of the system are interslidable in order to gain space.

7 Claims, 7 Drawing Sheets

MOVABLE OFFICE FURNITURE

TECHNICAL FIELD OF THE INVENTION

Figure 1B:
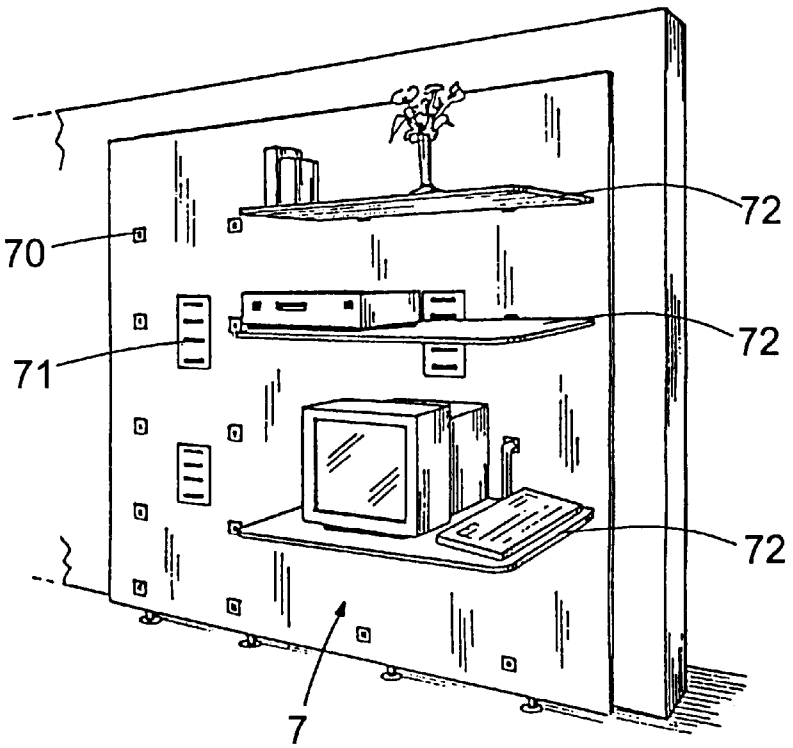

The present invention relates to a shelf-holding wall for mobile office furniture which can furthermore include tables, filing trolleys, cupboards and equipment boxes. The shelf-holding wall can be used in permanent company offices, at tradefairs, in conferences or in the home.

PRIOR ART

EP-A-0 477 961 discloses office furniture which can be combined according to the principle of modular construction, can be arranged in a variable manner, has diverse pieces of furniture and also includes partitions. Varied, individually adapted solutions can be constructed using the individual system components. However, the partitions which are shown only have the function of dividing the room in order to form defined working areas. Moreover, the partitions are connected to one another so that a certain outlay is necessary in order to dismantle the furniture and put it together again in a modified form. In particular in the case of situations changing ad hoc, the currently known partitions are to too small an extent capable of being adapted spontaneously. Although, with very simple partitions, it is possible to take suddenly arising conditions into consideration, partitions of this type offer only very limited options for configuring an optimum workstation because of their primitiveness.

OBJECT OF THE INVENTION

In view of the above described deficiencies of existing partitions for mobile office furniture systems for repeatedly changing requirements and in view of the changing way in which work is organized in office procedures and for household requirements, the invention is based on the following problem.

A shelf-holding wall for mobile office furniture which can be changed ad hoc and which can include the system components of tables, filing trolleys, cupboards and equipment boxes is to be provided. The shelf-holding wall should be able to be combined with the said system components in a space-saving manner and for optimum configuration of a workstation for business use at a permanent location, for exhibitions or conventions and also for household use. In particular, the shelf-holding wall which is to be provided is intended to be multifunctional.

SUMMARY OF THE INVENTION

The shelf-holding wall can be fitted individually with shelves and can also be provided as a double wall with opposite workstations. The supply lines and connections for the power supply and the telecommunications technology are laid behind the shelf-holding wall or between a double wall. For soundproofing, which is particularly desirable at tradefairs or in open-plan offices, the shelf-holding wall can be constructed with a sound-absorbing material.

A plurality of shelves are mounted one above another in a shelf-holding wall, the lowermost shelf being used for the arrangement of a visual display unit. Arm-shaped shelf supports are either latched into plug-in sockets, which are situated in the front panel of the shelf-holding wall, or the shelf supports are fastened through the front panel to a base frame. It is advantageous to use a front panel having a grid of holes, it being possible to insert into the grid rapidly releasable clamping levers which support accessories, such as bookends, pen trays or baskets. The provision of cables for supplying power to electrical equipment takes place by means of bushings inserted into the front panel or through a cable duct which can be opened and covered. To cover the cable duct there are provided two covering panels which are coupled to levers and can be pivoted toward each other or away from each other.

One of the tables is moved up against the shelf-holding wall and its table top is partially pushed under the shelf provided with the visual display unit. When leaving this workstation it is possible to move one of the trolley types under the table and up to the shelf-holding wall. This enables a plurality of system components to be arranged in a space-saving manner and a spontaneous workstation to be individually set up, with the working implements being at an ergonomically advantageous reaching or visual distance.

BRIEF DESCRIPTION OF THE ATTACHED DRAWINGS

Figure 1A:
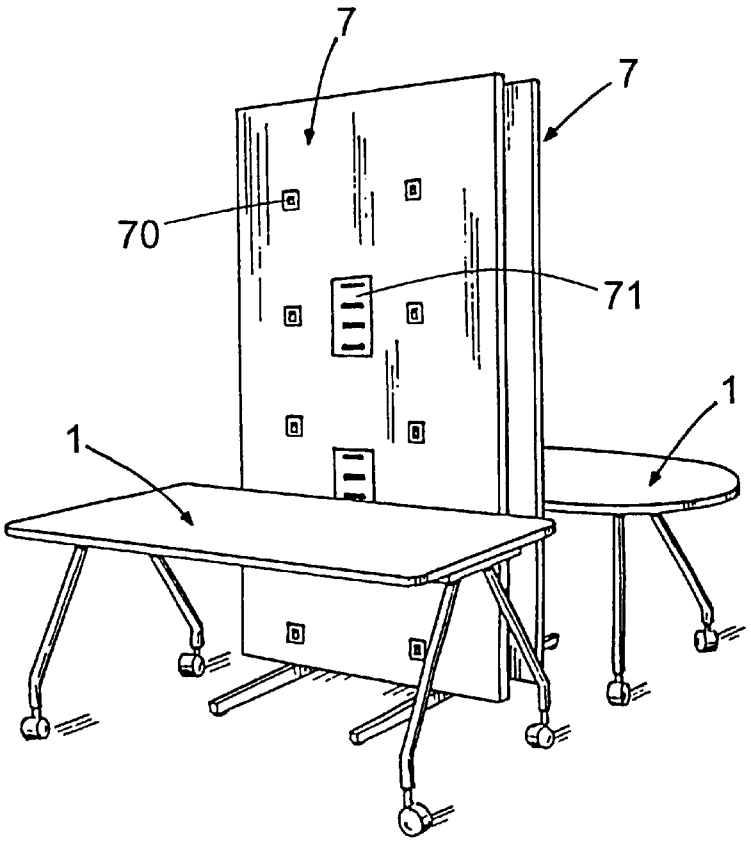
Figure 1D:
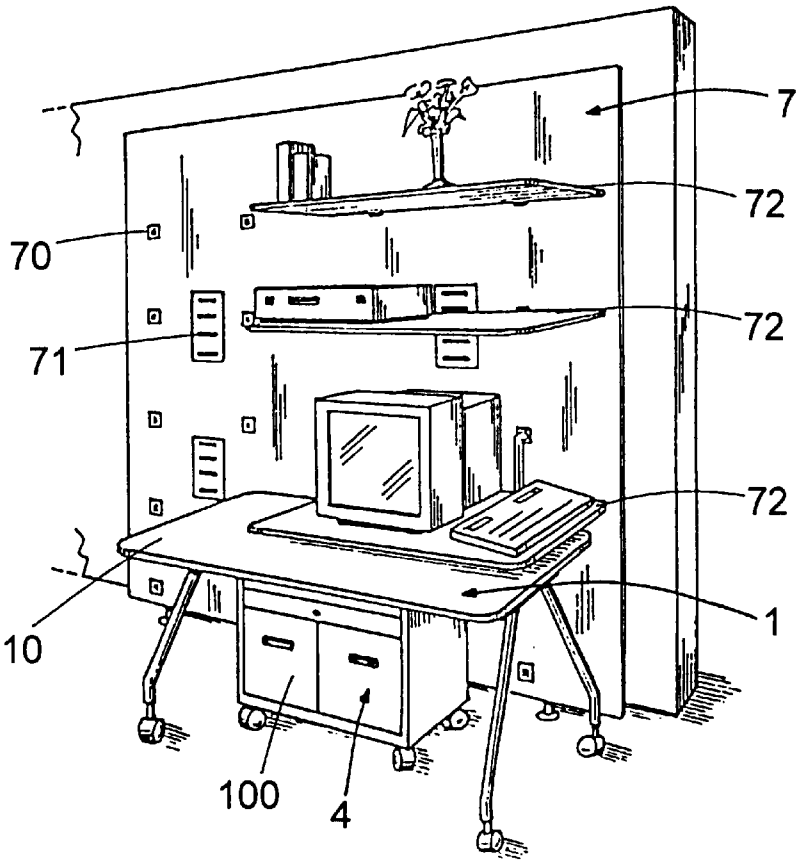
Figure 1C:
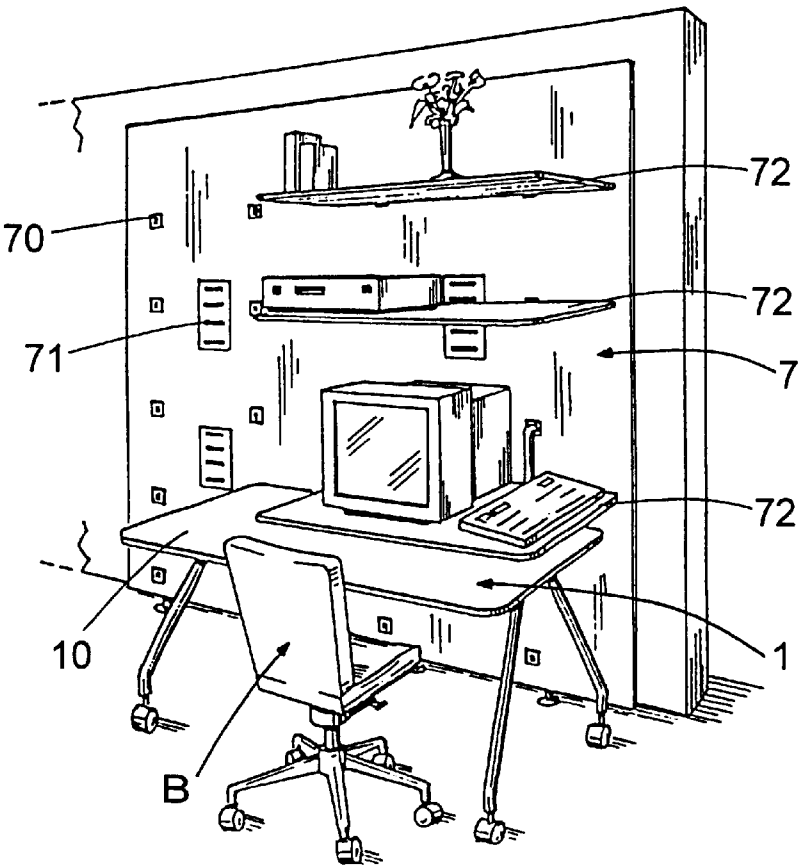
Figure 2C:
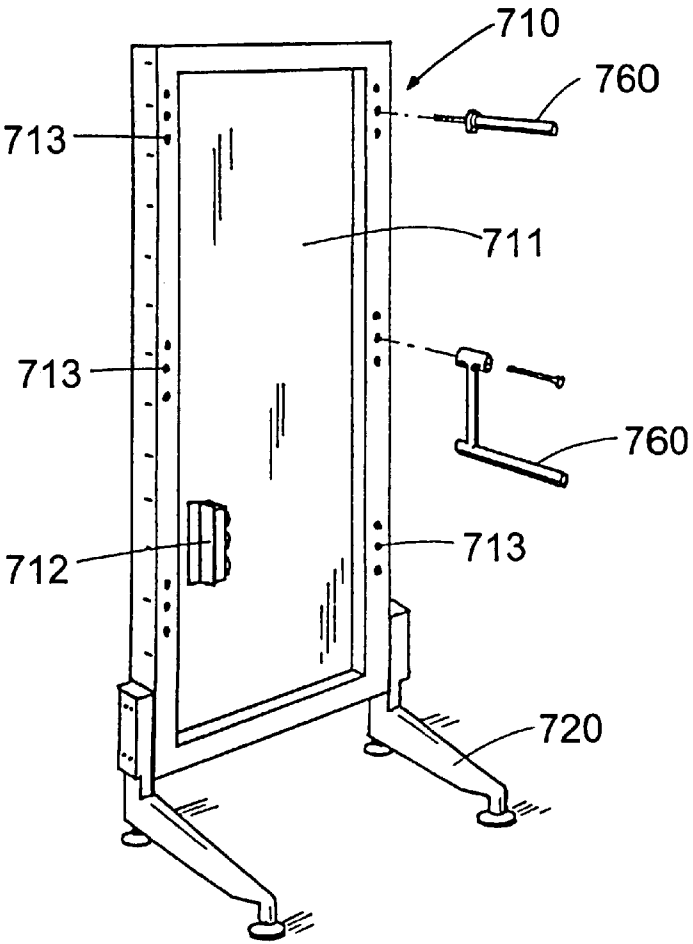
Figure 2A:
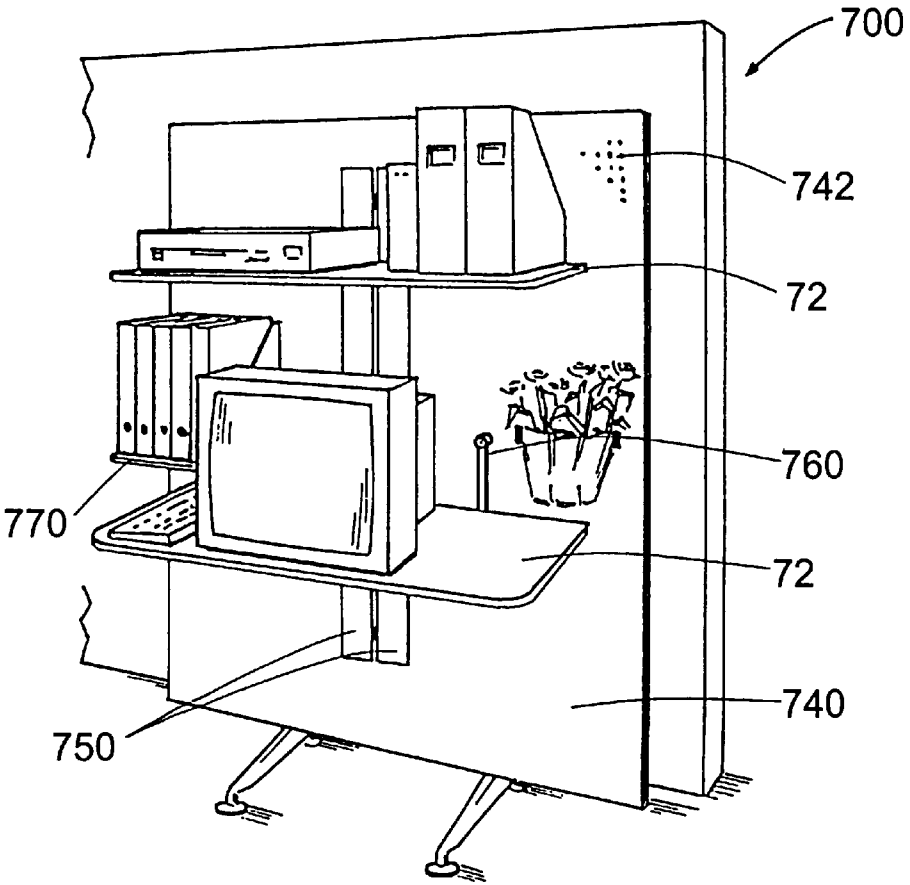
Figure 2B:
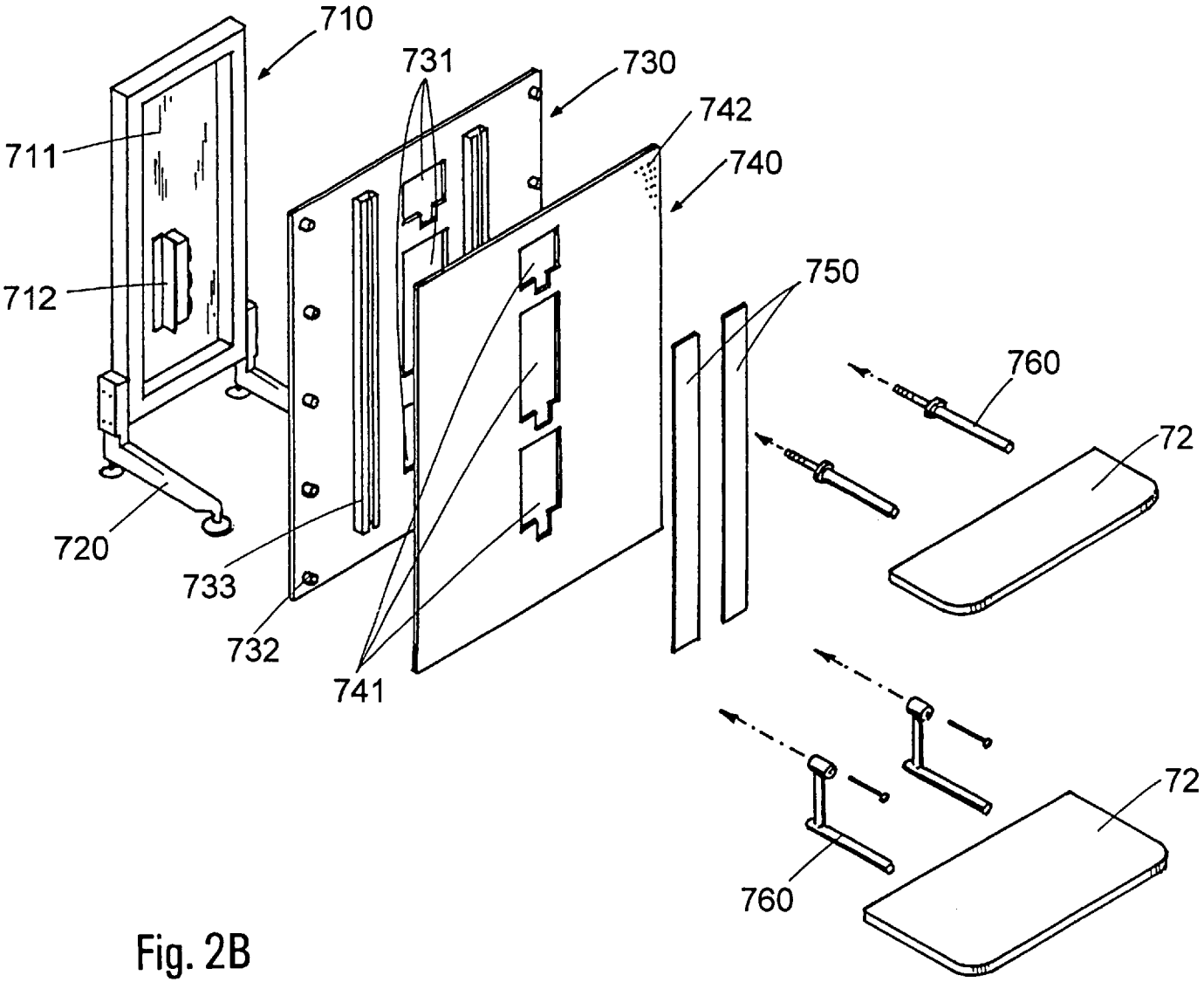
Figure 2E:
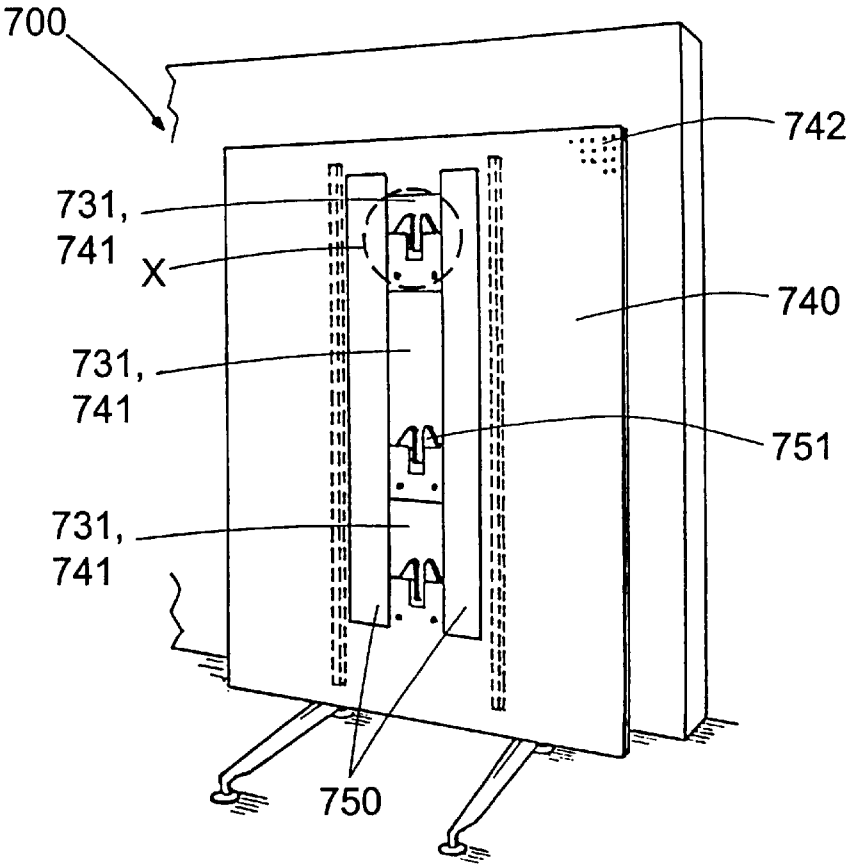
Figure 2D:
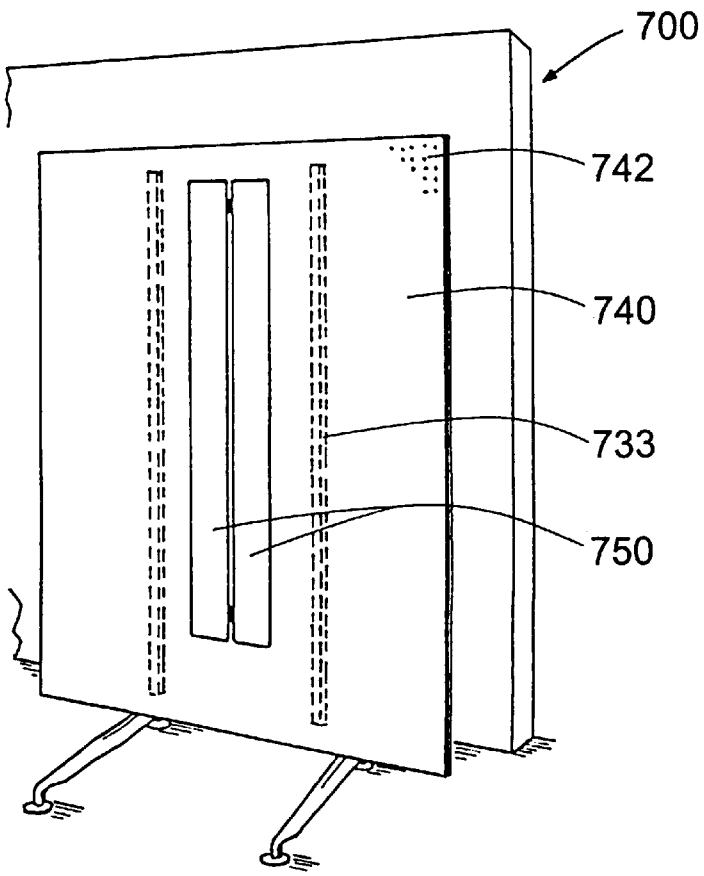
Figure 2F:
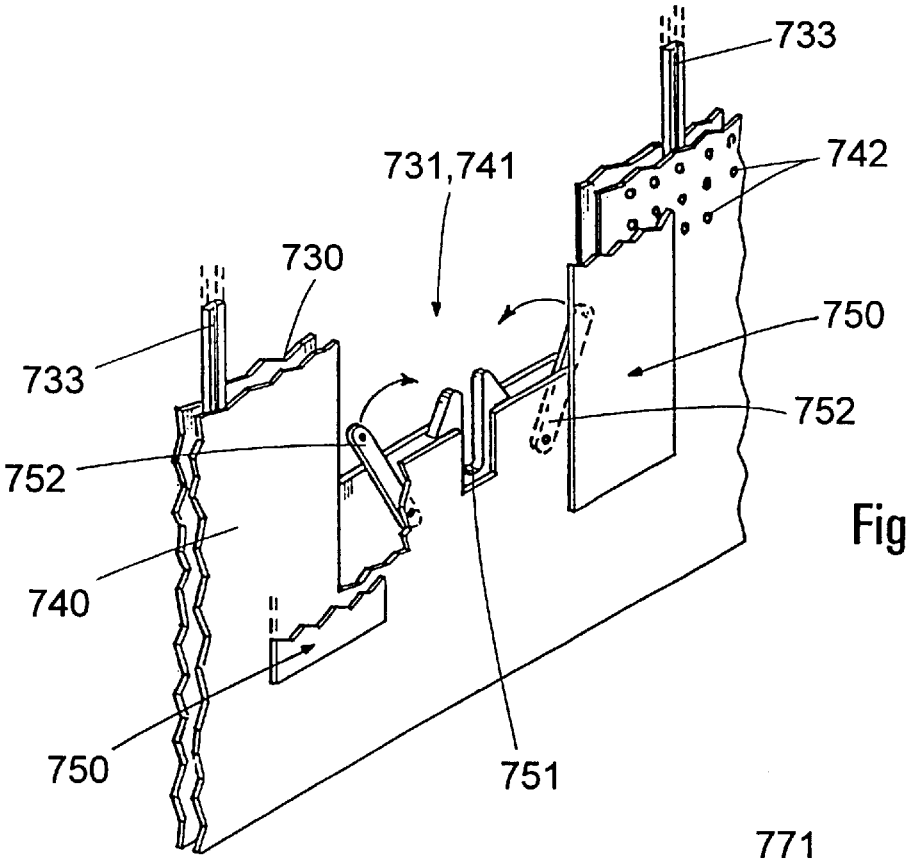
Figure 2G:
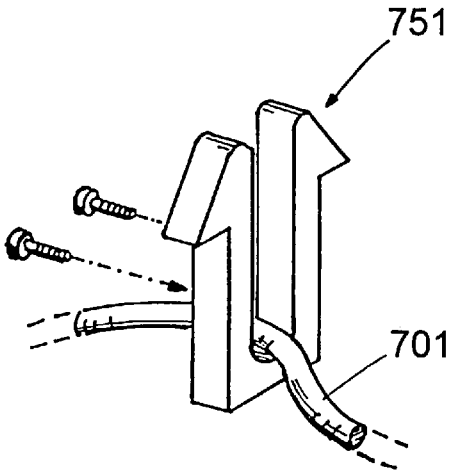
Figure 3A:
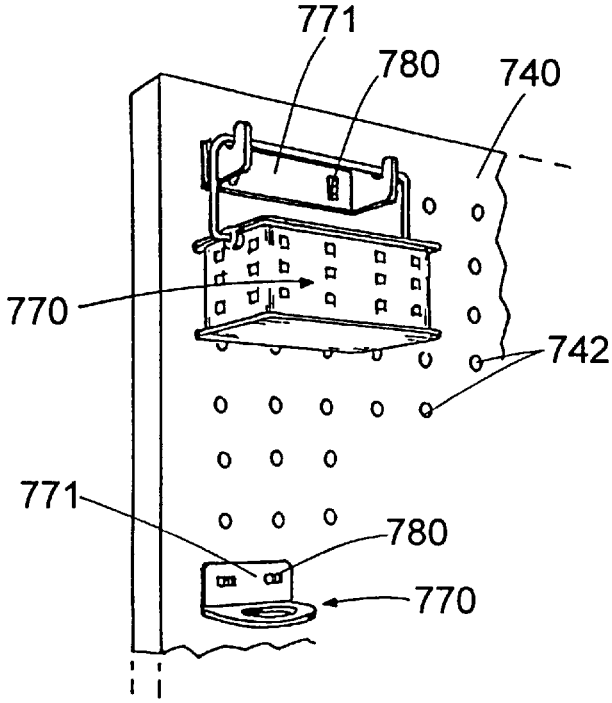
Figure 3B:
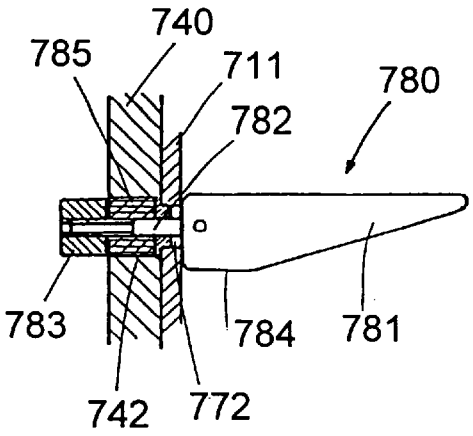
Figure 4B:
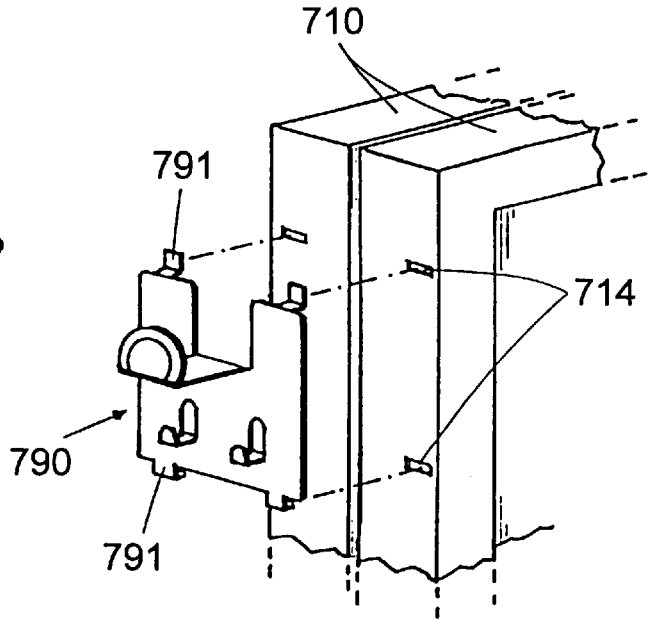
Figure 4A:
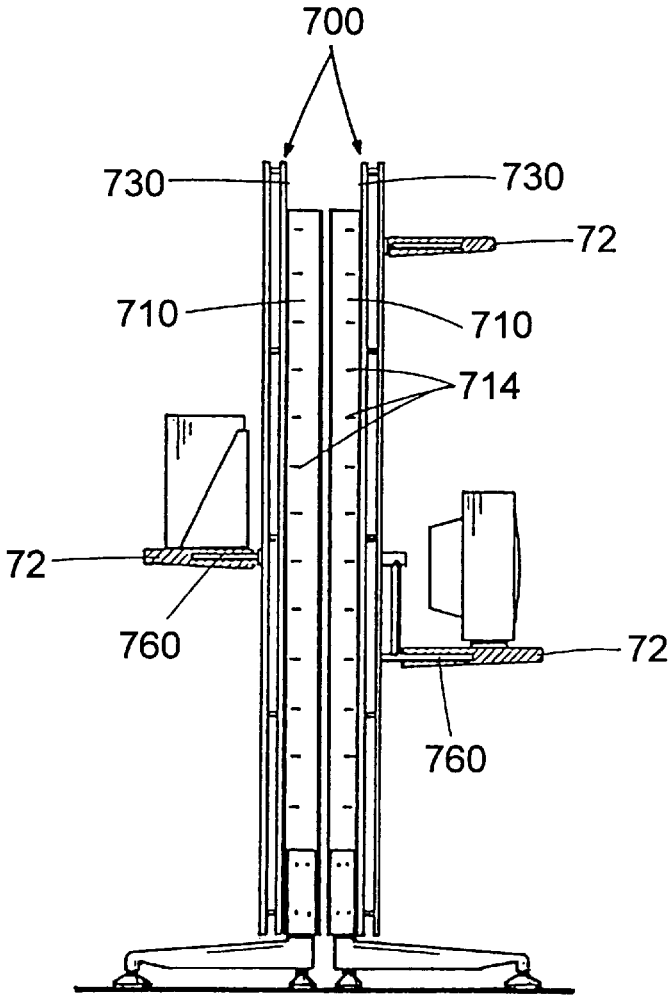

The drawings show the following:

FIG. 1A: two shelf-holding walls of the first design with their rear sides placed next to one another and having punctiform cable bushings, plug-in sockets and tables;

FIG. 1B: a shelf-holding wall according to FIG. 1A with shelves arranged one above another;

FIG. 1C: the shelf-holding wall according to FIG. 1B with a table pushed up to it;

FIG. 1D: the shelf-holding wall according to FIG. 1C with a trolley additionally pushed underneath;

FIG. 2A: a shelf-holding wall of the second design with a perforated panel on the front side and a cable duct;

FIG. 2B: an exploded representation of the assembly of the shelf-holding wall according to FIG. 2A;

FIG. 2C: the base frame of a shelf-holding wall having feet and shelf supports according to FIG. 2B lined up with it;

FIG. 2D: the unequipped shelf-holding wall according to FIG. 2A with a closed cable duct;

FIG. 2E: the shelf-holding wall according to FIG. 2D with an open cable duct;

FIG. 2F: the detail X from FIG. 2E;

FIG. 2G: a cable support;

FIG. 3A: a cutout from the perforated panel according to FIG. 2A equipped with two accessories;

FIG. 3B: a clamping lever in the perforated panel according to FIG. 2A;

FIG. 4A: two shelf-holding walls according to FIG. 2A with their rear sides placed next to one another; and FIG. 4B: a side element lined up with the two base frames which are standing together according to FIG. 4A.

EXEMPLARY EMBODIMENT

A detailed description of a preferred exemplary embodiment of the shelf-holding wall according to the invention takes place below with reference to the attached drawings.

FIG. 1A

The shelf-holding wall 7 of the first design can be erected as a one-sided panel or as a double wall of two shelf-holding walls 7 with their rear sides placed next to one another—as shown here. Receiving elements 70 for hooking in shelves are inserted in the shelf-holding wall 7. Furthermore, there are punctiform bushings 71 in the shelf-holding wall 7 for the passage of power supply cables. For particular applications—for example, in open-plan offices or on trade-fair stands—it is of advantage to manufacture the shelf-holding wall 7 from a sound-absorbing material. Tables 1 can be pushed up to the shelf-holding wall 7—in the case of double walls, consequently, from both sides.

FIG. 1B

In the example here, a plurality of shelves 72 are mounted one above another in a shelf-holding wall 7, to which end the receiving elements 70 are of use. The lowermost shelf 72 is used for setting up a visual display unit. The shelves 72 situated higher up are occupied by further equipment and implements.

FIG. 1C

A table 1 is moved up to the shelf-holding wall 7 and its table top 10 is partially pushed under the shelf 72 which is provided with the visual display unit. The remaining, free surface of the table top 10 can be used, for example, for a keyboard, a mouse and working documents. The dimensioning of the table 1 and the arrangement of the visual display unit on the shelf 72 result in ergonomically favorable working conditions for the user B. Should the table 1 spontaneously be required for another purpose and it has therefore to be pulled away from the shelf-holding wall 7, this can take place quickly without having also to clear away the voluminous video display unit.

FIG. 1D

If more freedom of movement is required once again in the working space, or the work is finished, the knee-high trolley 2 and/or the half-height trolley 4 can be moved under the table 1. The equipment box 6 can also be put under it. A plurality of system components of the office furniture thus fit into one another in a space-saving manner.

FIG. 2A

The shelf-holding wall 700 of the second design has, on the front side, a perforated panel 740 with holes 742 arranged in the form of a grid and intended for holding various accessories 770, for example a file supporting means. The shelves 72 are supported by supporting arms 760 which are fastened to the base frame of the shelf-holding wall 700. Instead of the punctiform cable bushings, in this case there is provided, in the center of the perforated panel 740, a slot-shaped vertical cable duct which can be covered by means of two strip-shaped wings 750, which can be pivoted apart from one another, so that the cable duct only remains open to the extent of the slot width which corresponds to the diameter of the cables protruding through.

FIG. 2B

A supporting part of the shelf-holding wall 700 is a base frame 710 with a clamping wall 711 arranged on the rear side, feet 720 being arranged for erecting the shelf-holding wall 700 on the base frame 710. A socket unit 712 is fastened on the clamping wall 711. Onto the base frame 710 there is placed a rear wall 730 which protrudes over the base frame 710 on all sides. In the center of the rear wall 730 there are a plurality of openings 731 one under the other. The perforated panel 740 on the front side and having the openings 741 is congruent in its outer dimensions and with respect to the openings 731,741 and is placed onto the rear wall 730. Numerous spacer elements 732 and also two stabilizing struts 733 are mounted on the rear wall 730, facing the perforated panel 740, so that a clearance remains between the rear wall 730 and the front perforated panel 740. As a covering for the openings 731,741, which form the cable duct, there are provided two strip-shaped wings 750 which are placed pivotably onto the perforated panel 740. Shelves 72 are supported by means of supporting arms 760 which protrude through the rear wall 730 and the perforated panel 740 and which are fastened to the base frame 710. The supporting arms 760 are of straight and bent design.

FIG. 2C

For fastening the supporting arms 760 to the base frame 710 bores 713, for example, threaded bores are provided on said base frame in a grid pattern. Consequently, the user can equip the shelf-holding wall 700 with shelves 72 in a very variable manner in terms of height and without relatively great expenditure by certain bores 713 being used to hold straight or bent supporting arms 760.

FIGS. 2D to 2G

If the wings 750 resting on the perforated panel 740 have been pivoted toward one another, the openings 731,741 lying behind them in the rear wall 730 and in the perforated panel 740, which openings form the cable duct, are completely covered. Only if cables 701 protrude between the two wings 750 does a narrow slot of the diameter of the cables remain open.

For using the cables 701, for example, when plugging a power supply cable into the socket unit 712, the wings 750 are pivoted open. The openings 731,741 are now accessible in their full width from the front so that cable connectors can be introduced manually into the socket unit 712 without any impediment. The differing heights of the openings 731,741 make possible short cable lengths in front of the shelf-holding wall 700 to the equipment to be connected. To protect the cables 701 protruding through the openings 731,741 upwardly open, U-shaped cable protectors 751 are inserted between the rear wall 730 and perforated panel 740, in each case at the lower edge of the openings 731,741. The wings 750 are supported and made pivotable by means of levers 752 which are coupled, on the one hand, between the rear wall 730 and the perforated panel 740, and, on the other hand are coupled to the wings 750.

FIGS. 3A and 3B

Accessories 770, such as file supporting means, baskets or trays, are fastened to the perforated panel 740 by means of clamping levers 780. The accessories 770 have a bracket 771 with bores 772, which bracket can be placed onto the perforated panel 740. A clamping lever 780 is passed through the bores 772 in the bracket 771 and through at least one hole 742 in the perforated panel 740. The clamping lever 780 consists of a toggle 781, which can be swung down, a pin 782 coupled to said toggle, a rubber body 785 surrounding the pin 782 and a locking securing element 783 which is fastened to the pin 782. The rubber body 786 can be plugged through the bore 772 and the hole 742, while in the unclamped state the toggle 781 rests with its end side, which faces the rubber body 785, on the bracket 771.

By pivoting down the toggle 781 the clamping lever 780 is clamped. Its side flank 784 comes to rest on the bracket 771 and the pin 782 is pulled forward. Consequently, the rubber body 785 is squeezed and widens and thereby becomes wedged within the hole 742. The securing element 783 is preferably a nut, it being possible to adjust the pretensioning of the clamping lever 780, by compressing the rubber body 785, with the nut being screwed on further.

FIGS. 4A and 4B

Within a room, two shelf-holding walls 700 can be placed next to one another with their rear sides unconnected or connected so that two base frames 710 come together. The clearance produced thereby between the two rear walls 730 can be used for attaching side elements 790, such as suspension means, cloakroom pegs and storage panels. The side elements 790, which can extend over the width of one or two base frames 710, have hook-in lugs 791. In the externally accessible flanks of the base frame 710 there is a vertically arranged grid having a plurality of holes 714. The hook-in lugs 791 are complementary to these holes 714 so that side elements 790 can be suspended on the flanks of the base frames 710.

Depending on the manner in which the shelf-holding wall 700 is erected, the feet 720 are designed as extension arms—for freestanding use—or only as a floor spacer element, for wall fitting.

What is claimed is:

1. A shelf-holding wall for mobile office furniture, comprising:

a) an upright base frame (710);

b) a rear wall (730) which is placed onto the base frame (710) and in which there is at least one opening (731) for the leading-through of cables (701);

c) a perforated panel (740) which is placed congruently onto the rear wall (730) using spacer elements (732) and which has a grid of holes (742) to be used for the optional attachment of accessories and an opening (741) which is congruent to said at least one opening (731) in said rear wall (730);

d) at least one pivotable wing (750) which is placed onto the perforated panel (740) and is used for concealing the openings (731, 741) which are used as a cable duct; and e) supporting arms (760) which are fastened to the base frame (710), protrude through the rear wall (730) and perforated panel (740) and are intended for supporting shelves (72).

2. The shelf-holding wall as claimed in claim 1, wherein a) there are a plurality of openings (731, 741) which lie one above the other in the center of the rear wall (730) and of the perforated panel (740);

b) said at least one pivotable wing (750) includes a pair of strip-shaped pivotable wings (750) for covering the openings (731, 741), one of said pair of wings (750) being positioned on one side of said openings (731, 741) and the other of said pair of wings (750) being positioned on the other side of said openings (731, 741); and c) within the base frame (710) there is arranged a socket unit (712) into which cables (701), which lead to equipment in front of the shelf-holding wall (700), can be plugged manually through the openings (731, 741).

3. The shelf-holding wall as claimed in claim 1 or 2, wherein into said shelf-holding wall (7)

a) a multiplicity of receiving elements (70) are inserted for supporting shelves (72) having mounting means sized and shaped to be inserted into said receiving elements (70); and b) at least one punctiform bushing (71) is inserted to be used for the feeding-in of electrical cables.

4. The shelf-holding wall as claimed in claim 1, wherein said shelf-holding wall (7,700) includes a sound-absorbing material.

5. The shelf-holding wall as claimed in claim 1, wherein a) two of said shelf-holding walls (7, 700) standing with their rear sides next to one another can be set up in the room as a double wall; and b) said base frames (710) of said shelf-holding walls (7, 700) each have a side flank with a grid of holes (714) sized and shaped to receive hook-in lugs (791) of side elements (790) which span said base frames (710).

6. The shelf-holding wall as claimed in claim 1, wherein a lowermost one of said support shelves (72) is inserted into said shelf-holding wall, such that a table (1) can be pushed under said lowermost shelf, with additional objects capable of being placed under said table (1).

7. The shelf-holding wall as claimed in claim 1, wherein said base frame (710) has a side flank with a grid of holes (714) that are sized and shaped to receive hook-in lugs (791) of at least one side element (790).

* * * * *